US006973903B2

(12) United States Patent
Santi

(10) Patent No.: US 6,973,903 B2
(45) Date of Patent: Dec. 13, 2005

(54) VALVE-OPERATING LEVER

(75) Inventor: John D. Santi, West Allis, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 10/646,197

(22) Filed: Aug. 22, 2003

(65) Prior Publication Data

US 2005/0039714 A1 Feb. 24, 2005

(51) Int. Cl.[7] ..... F01L 1/18
(52) U.S. Cl. ..... 123/90.39; 123/90.44
(58) Field of Search ..... 123/90.15, 90.16, 123/90.17, 90.18, 90.39, 90.4, 90.44, 90.6, 123/90.61; 74/559, 567, 569; 29/888.2

(56) References Cited

U.S. PATENT DOCUMENTS

| | | | | |
|---|---|---|---|---|
| 1,500,166 A | | 7/1924 | Van Ranst | |
| 3,418,985 A | | 12/1968 | Hirose | |
| 4,369,742 A | | 1/1983 | Everts | |
| 4,510,897 A | | 4/1985 | Hatz et al. | |
| 4,662,323 A | | 5/1987 | Moriya | |
| 4,698,877 A | * | 10/1987 | Lautenschlager et al. | 16/235 |
| 5,022,360 A | * | 6/1991 | Cholewczynski | 123/90.27 |
| 5,092,634 A | | 3/1992 | Miller | |
| 5,101,778 A | | 4/1992 | Fukuo et al. | |
| 5,241,932 A | | 9/1993 | Everts | |
| 5,280,776 A | * | 1/1994 | Dick | 123/557 |
| 5,357,917 A | | 10/1994 | Everts | |
| 5,706,769 A | | 1/1998 | Shimizu | |
| 5,738,062 A | | 4/1998 | Everts | |
| 5,769,499 A | * | 6/1998 | Dudash et al. | 297/452.18 |
| 5,884,593 A | | 3/1999 | Immel et al. | |
| 6,199,527 B1 | * | 3/2001 | Okubo et al. | 123/90.41 |
| 6,349,688 B1 | * | 2/2002 | Gracyalny et al. | 123/90.39 |
| 6,550,435 B1 | * | 4/2003 | Zubeck | 123/90.16 |
| 6,612,275 B2 | * | 9/2003 | Immel et al. | 123/90.31 |
| 6,634,330 B2 | * | 10/2003 | Matsuda et al. | 123/90.39 |
| 6,739,304 B2 | * | 5/2004 | Reinbold et al. | 123/193.5 |
| 2002/0108596 A1 | | 8/2002 | Gracyalny et al. | |

FOREIGN PATENT DOCUMENTS

| | | |
|---|---|---|
| DE | 43 37 594 | 5/1995 |
| GB | 156038 | 1/1921 |

* cited by examiner

*Primary Examiner*—Thomas Denion
*Assistant Examiner*—Ching Chang
(74) *Attorney, Agent, or Firm*—Michael Best & Friedrich, LLP

(57) ABSTRACT

A valve-operating lever comprising a valve arm including a first aperture defining a valve arm engagement portion. The lever also includes a connector member having an outside surface and a first stop. The connector member and the first stop cooperate to define a first engagement portion. A first portion of the connector member overlays a portion of the valve arm adjacent the first aperture, and the valve arm engagement portion engages the first engagement portion.

13 Claims, 9 Drawing Sheets

VALVE-OPERATING LEVER

BACKGROUND OF THE INVENTION

The present invention relates generally to internal combustion engines. More particularly, the present invention relates to a direct lever for controlling valve opening and closing.

Internal combustion engines include valves that are operated at precise intervals to allow fuel and air to enter a cylinder or to allow exhaust gas to escape. Typically, a cam shaft driven by the engine actuates the valves to control the timing.

Many engines include valve-actuating levers that actuate push rods to open and close valves. The actuating levers include one arm that rides on a cam and a second arm that actuates the push rod. One such valve-actuating lever is disclosed in U.S. Pat. No. 6,349,688 to Gracyalny. However, the valve-actuating lever of Gracyalny is costly to manufacture and requires precise techniques to maintain the necessary tolerances.

SUMMARY OF THE PREFERRED EMBODIMENTS

The present invention provides a valve-operating lever comprising a valve arm including a first aperture defining a valve arm engagement portion. The lever also includes a connector member having an outside surface and a first stop. The connector member and the first stop cooperate to define a first engagement portion. A first portion of the connector member overlays a portion of the valve arm adjacent the first aperture, and the valve arm engagement portion engages the first engagement portion.

In another aspect, the invention provides a direct lever system for an engine. The system including a cylinder bore having an outer end. The system also includes a cam assembly having at least one cam surface and an axis inward of the outer end of the cylinder bore, two valves having opened and closed positions, and two valve stems. Each valve stem is attached to one of the two valves. A cylinder head substantially encloses the outer end, with the valves being seated in the cylinder head. The system further includes two pivotably mounted valve-operating levers. At least one of the valve-operating levers includes a connector member having a lever arm end and a valve arm end. The connector member defines a pivot axis about which the valve-operating lever pivots. The valve-operating lever also includes a lever arm having an aperture. A portion of the connector member overlays at least a portion of the lever arm adjacent the aperture to fixedly attach the lever arm to the connector member. The lever arm has a cam follower surface in contact with the at least one cam surface, and a valve arm including an aperture. A portion of the connector member overlays at least a portion of the valve arm adjacent the aperture to fixedly attach the valve arm to the connector member.

In yet another aspect, the invention provides a method of manufacturing a valve-operating lever that includes a connector member having an outside diameter. The method includes providing a valve arm having a first aperture, and forming a first stop at a first end of the connector member. The method also includes positioning the valve arm adjacent the first stop such that at least part of the connector member is positioned within the first aperture, and deforming the first end of the connector member to fixedly attach the valve arm to the connector member.

In still another aspect, the present invention provides a method of assembling a valve-operating lever, the valve-operating lever including a valve arm having a first aperture, a lever arm having a second aperture, and a connector member. The method includes positioning the valve arm on a first end of the connector member such that a portion of the connector member extends at least partially through the first aperture. The method also includes roller burnishing the first end of the connector member to deform the first end of the connector member, and fixedly attach the valve arm to the connector member. The method further includes positioning the lever arm on a second end of the connector member such that a portion of the connector member extends at least partially through the second aperture. The method also includes roller burnishing the second end of the connector member to deform the second end of the connector member and fixedly attach the lever arm to the connector member.

Additional features and advantages will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
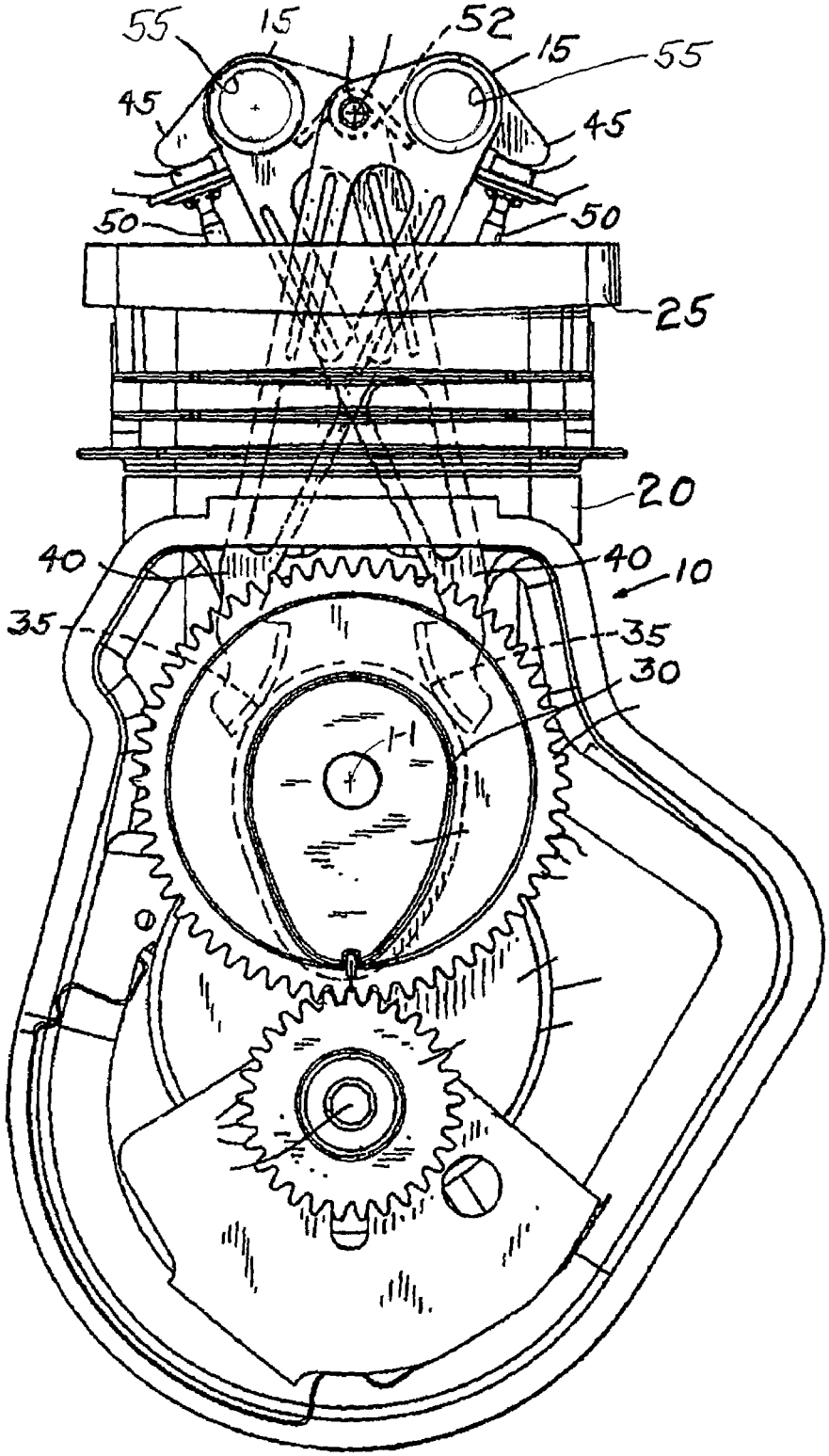
FIG. 1 is a front view of an engine including valve-operating levers embodying the present invention.

With reference to FIG. 1, an internal combustion engine 10 including two valve-operating levers 15 of the present invention is illustrated. The engine 10 is similar to the engine disclosed in U.S. Pat. No. 6,349,688 the contents of which are incorporated herein by reference.

The engine 10 of FIG. 1 includes a cylinder 20 having a bore in which a piston reciprocates. The cylinder bore has an outer end adjacent a cylinder head 25 and the top dead center (TDC) position of the piston. The engine 10 also includes a cam assembly 30 that has one or more cam surfaces 35. The cam assembly 30 rotates about an axis 1—1 that is positioned inward, or as in FIG. 1, beneath and in front of the outer end of the cylinder bore. During engine operation, two valves move between open and closed positions to admit fuel and air and to discharge exhaust gases.

Figure 2:
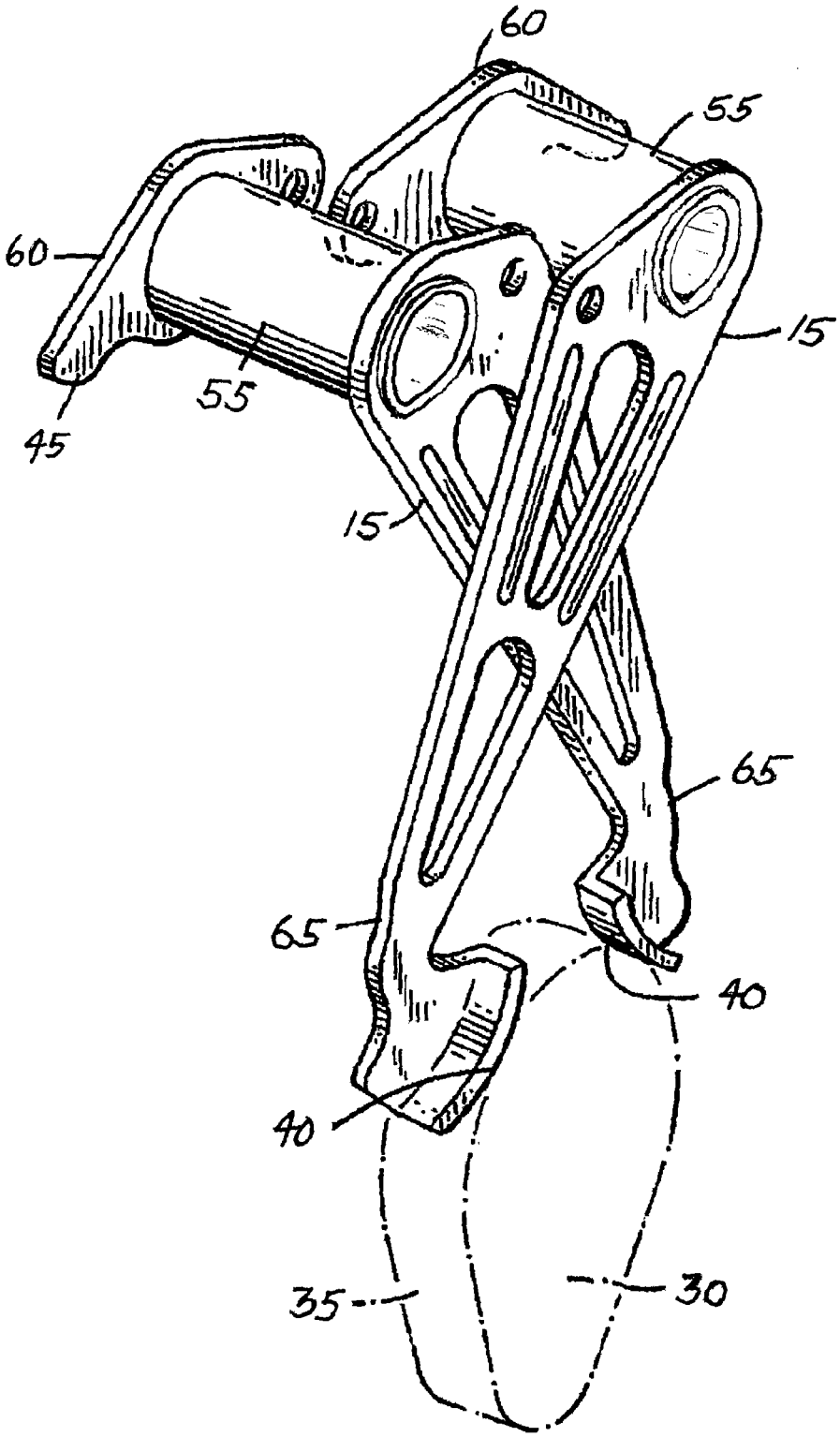
FIG. 2 is a perspective view of the valve-operating levers of FIG. 1.

As illustrated in FIGS. 1 and 2, each valve-operating lever 15 includes a follower portion 40 that rides on the cam surface 35 and a valve-actuating portion 45 that moves a push rod 50 to actuate the valve. Each valve includes its own valve-actuating lever 15 thus allowing for individual control of the valves. A biasing member, such as a torsional spring 52, biases the lever 15 to assure that the follower portion 40 remains in contact with the cam surface 35 at operating speeds.

Figure 3:
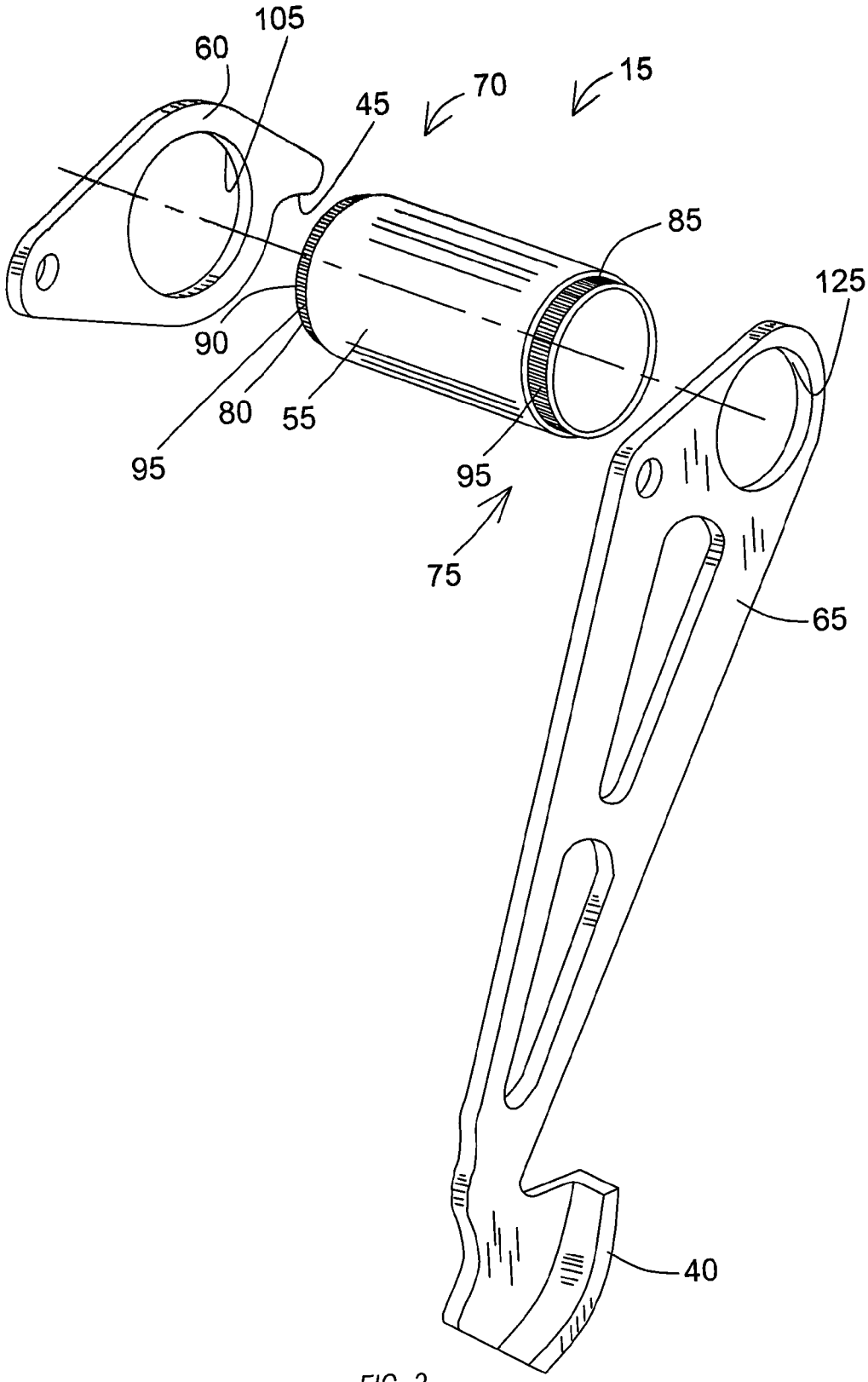
FIG. 3 is an exploded perspective view of one of the valve-operating levers of FIG. 2.

FIG. 3 illustrates the components of the valve-operating lever 15 in more detail. The valve-operating lever 15 includes a connector member 55, a valve arm 60, and a follower arm 65. The connector member 55 is preferably a generally hollow tubular member having a first end 70 and a second end 75. The first end 70 includes a first reduced-diameter portion 80, and the second end 75 includes a second reduced-diameter portion 85. The first reduced-diameter portion 80 defines a first stop in the form of a first shoulder 90, while the second reduced-diameter portion defines a second stop in the form of a second shoulder 92. The reduced-diameter portions 80, 85 provide attachment points for the valve arm 60 and the follower arm 65.

In other constructions, the stops take forms other then shoulders 90 defined by reduced-diameter portions 80, 85. For example, one construction uses a ridge positioned along the length of a substantially constant diameter connector member. In this construction, no reduced diameter portion or shoulder is necessary. In still another construction, small intermittent upsets of the connector member material cooperate to function as stops. In still another construction, the connector member 55 includes lances that extend slightly above the surface of the connector member 55. The lances limit axial movement of the arms 60, 65 along the connector member 55. As should be clear, the stops can take many forms. As such, the invention should not be limited to the few examples described herein. Any component or feature that acts to inhibit the free movement of the arms 60, 65 along the length of the connector member 55 can be considered a stop.

The wall thickness of the connector member 55 along with the diameter are chosen to assure adequate torsional stiffness during operation, while still providing the necessary machinability to complete the assembly. Thus, while a thick wall will result in good stiffness, the wall may be too thick to deform during the assembly process. On the other hand, a thin wall can result in inadequate stiffness, which may cause inaccurate movement, incomplete valve actuation, or early failure of the connector member 55. As such, many different wall diameters and wall thicknesses are envisioned. In one construction, a solid cylinder is used. The ends of the solid cylinder are bored out to provide regions that are connectable to the valve arm 60 and the follower arm 65. In another construction, the wall thickness is thin enough to facilitate attachment of the valve arm 60 and the follower arm 65 without providing a reduced-diameter portion 80, 85. In this construction, the arms attach directly to the outer surface of the connector member and a stop other than a reduced diameter portion is employed (e.g., lances).

Figure 4:
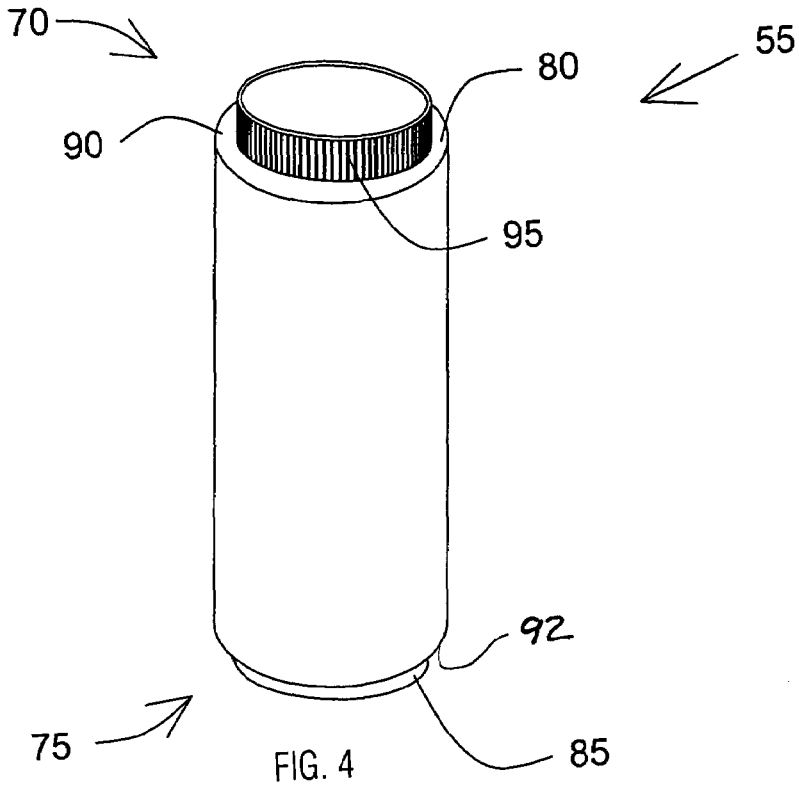
FIG. 4 is a perspective view of a connector member of the valve-operating lever.

Turning to FIG. 4, the first reduced-diameter portion 80 of the connector member 55 is better illustrated. The first reduced-diameter portion 80 defines the first shoulder 90 adjacent the large diameter of the connector member 55. In addition, the first reduced-diameter portion 80 of FIG. 4 includes a knurled surface 95. The knurls 95 provide a rough or uneven surface that improves the connection between the connector member 55 and the arms 60, 65. While the term "knurl" is commonly used to describe a specific surface texture that enhances one's grip on an object, as used herein the term "knurl" should be read broadly. More specifically, the term "knurl" should be read to include surface features such as, but not limited to knurling, axial grooves, radial grooves, angled grooves, and random patterns such as pin pricking, shot-peening, and like processes that provide a roughened surface.

The second reduced-diameter portion 85 is similar to the first reduced-diameter portion 80. As such, the second reduced-diameter portion 85 will not be described or illustrated in detail herein.

The valve arm 60, illustrated best in FIGS. 3 and 9–13, is a generally flat metallic piece that includes the valve-actuating portion 45 that is shaped to move the push rod 50. Other constructions may use other shaped valve arms or valve arms manufactured from other materials as may be required by the application. However, the use of a flat metal valve arm allows for the rapid stamping of substantially identical valve arms 60, thereby reducing the cost of the completed arm 60.

Figure 9:
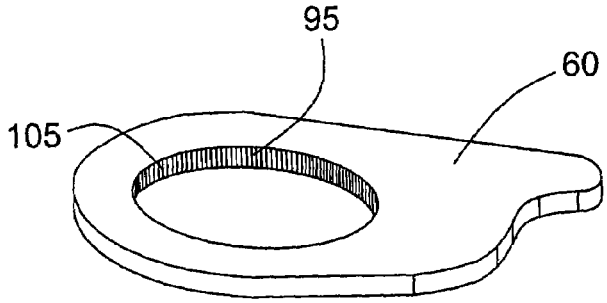
FIG. 9 is a perspective view of a valve arm.

The valve arm 60 includes an aperture 105 sized and shaped to allow attachment of the valve arm 60 to the first end 70 of the connector member 55. FIG. 9 shows a valve arm 60 formed to connect to the connector member 55 of FIG. 4. The aperture 105 is generally circular and includes a knurled surface 95. The knurls 95 of the aperture 105 engage the knurls 95 of the connector member 55 to inhibit relative rotation of the components following assembly. In other constructions, only one of the two surfaces (the connector member outer surface and the aperture inner surface) is knurled.

Figure 10:
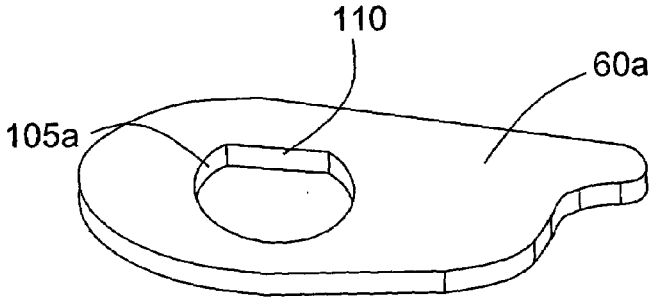
FIG. 10 is a perspective view of another valve arm.

In other constructions, an irregular or non-circular interface is used in place of, or in conjunction with knurled surfaces 95 to inhibit relative rotation between the connector member 55 and the valve arm 60. FIG. 10 illustrates one such construction of a valve arm 60*a* including a flat spot 110, or side, within the aperture 105*a*. The adjoining connector member (not shown) is formed to include a corresponding feature that allows the orientation of the two components to be substantially fixed relative to one another.

Figure 11:
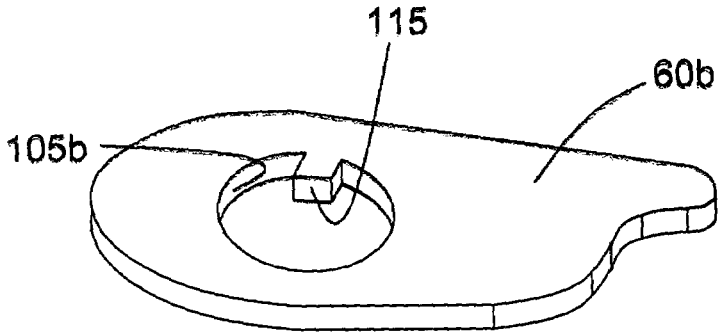
FIG. 11 is a perspective view of another valve arm.
Figure 12:
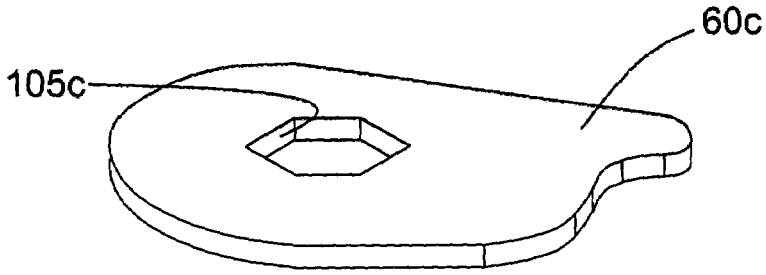
FIG. 12 is a perspective view of another valve arm.
Figure 13:
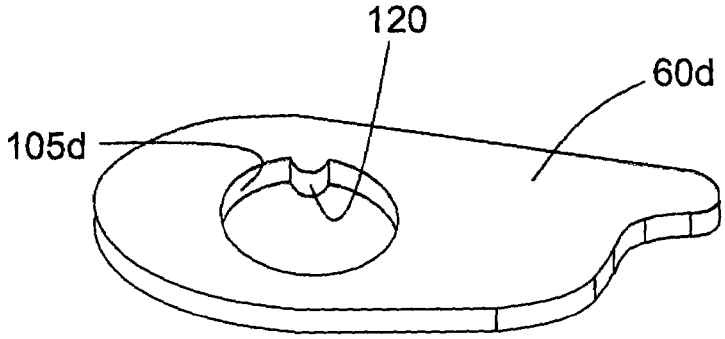
FIG. 13 is a perspective view of another valve arm.

Many other constructions are contemplated with a few examples illustrated in FIGS. 11–13. FIG. 11 illustrates a valve arm 60*b* having a generally circular aperture 105*b* with a tab 115 extending into the aperture 105*b*. The corresponding connector member (not shown) includes a slot that receives the tab 115. In another construction (not illustrated), the aperture in the valve arm includes a slot, as does the connector member. A key engages both slots to fix the relative positions of the components. FIG. 12 illustrates another construction in which the aperture 105*c* is polygonal in shape. The corresponding connector member (not shown) includes a substantially matching polygon. While a six-sided polygon is illustrated, it should be clear that any number of sides will perform the desired function. In still another example, illustrated in FIG. 13, a circular protrusion 120 extends into the aperture 105*d* of the valve arm 60*d*. Like the tab 115, the circular protrusion 120 engages a slot or indentation in the connector member (not shown). While the illustration of FIG. 13 includes an aperture 105*d* formed from circular features, it still includes a non-circular region that inhibits relative rotation between the connector member and the valve arm 60*d*. It should be noted that terms such as "non-circular" or "cross-section" are meant to indicate the shape of the aperture as it appears in a plane that is substantially parallel to the plane of the arm, or perpendicular to a centerline extending through the aperture.

The follower arm 65, illustrated best in FIGS. 2 and 3, attaches to the second end 75 of the connector member 55 in much the same manner as the valve arm 60 connects to the first end 70. The actual shape of the follower arm 65 is not important to the invention so long as it can perform its desired function. As such, a stamped or fabricated follower arm 65 will function with the present invention as will other follower arms manufactured in other ways.

The follower arm 65 includes a second aperture 125 that facilitates its attachment to the connector member 55. The aperture 125 is similar to the aperture 105 in the valve arm 60 and can include any and all of the attributes described above with regard to the valve arm aperture 105. As such, a detailed description of the follower arm aperture 125 is unnecessary.

Figure 5:
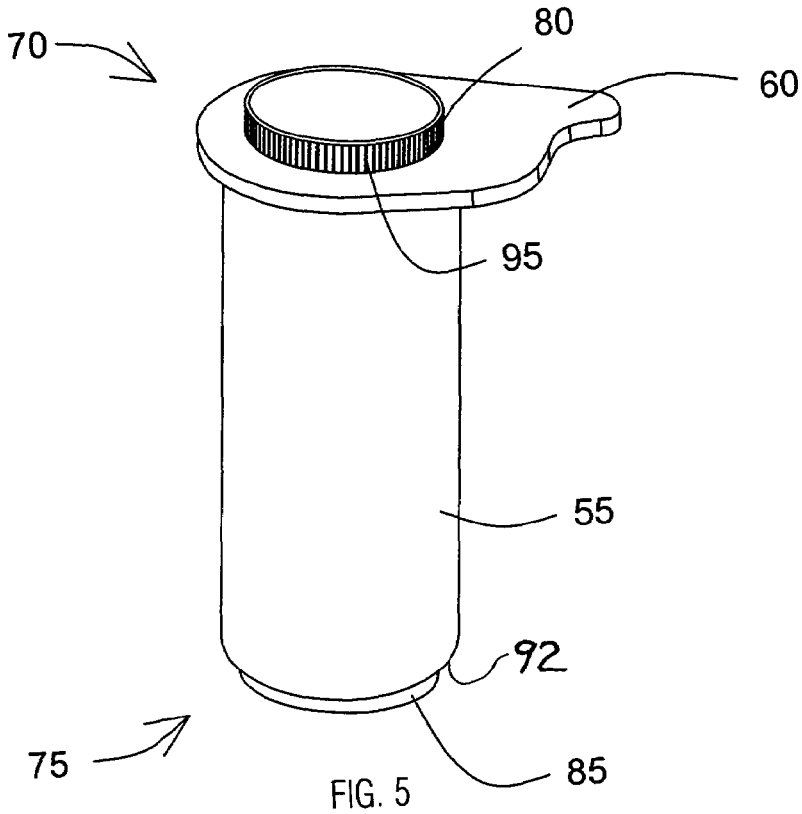
FIG. 5 is a perspective view of a partial assembly including the connector member and a valve arm.
Figure 6:
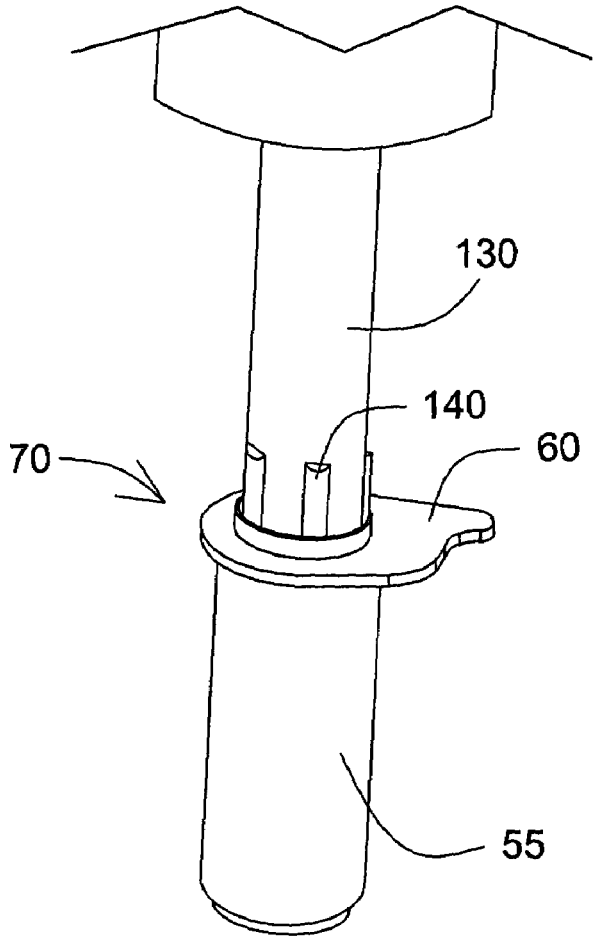
FIG. 6 is a perspective view of the partial assembly of FIG. 5 with a roller-burnishing tool inserted.

Turning to FIGS. 5–7 and 14–16, a method of assembling the valve-operating lever 15 will now be described. As shown in FIG. 5, the valve arm 60 is positioned over the first reduced-diameter portion 80 until it abuts the shoulder 90. In the construction of FIG. 5, the connector member 55 and the valve arm 60 include knurled surfaces 95 that serve to lock the angular position of the two components. Next, a roller-burnishing tool 130, illustrated in FIG. 6 is inserted into the opening of the first end 70 of the connector member 55. The roller-burnishing tool 130 deforms the reduced-diameter portion 80 of the first end 70 to produce a lip 135. The lip 135 is a portion of the connector member 55 that overlays a portion of the valve arm 60 and prevents its removal from the connector member 55.

Figure 7:
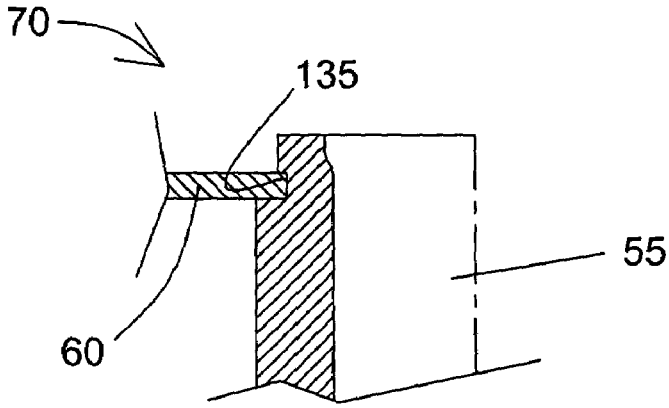
FIG. 7 is a cross-sectional view of the partial assembly after roller burnishing.

Roller burnishing is a cold-working process that sizes, finishes, and work hardens metal surfaces by pressure contact with hardened rollers. One roller burnishing tool 130, illustrated in FIG. 6, incorporates a planetary system of tapered rolls 140 that are evenly spaced by a retaining cage (not shown). When the tool 130 engages the connector member 55, a hardened mandrel (inside the tool), which is tapered inversely to the taper of the rolls 140, forces the rolls 140 against the inside surface of the connector member 55. The tool 130 is slightly larger than the pre-finished diameter of the hole and creates pressure that exceeds the yield point of the softer connector member 55 at the point of contact. The result is a small deformation of the reduced-diameter portion 80 of the connector member 55 as illustrated in FIG. 7.

Figure 14:
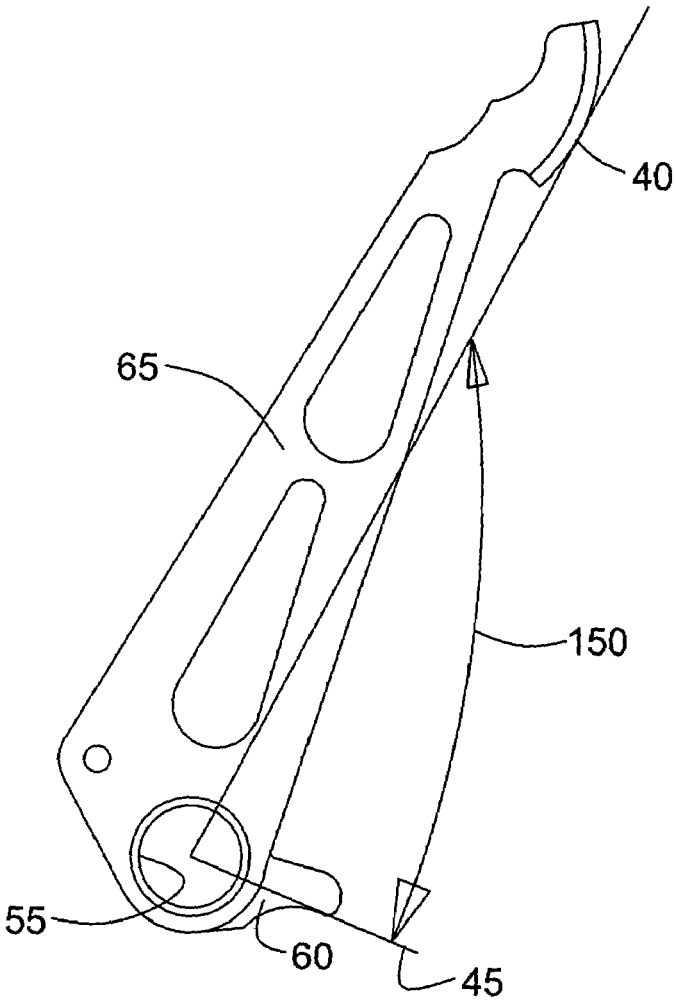
FIG. 14 is a front view of the valve-operating lever of FIG. 2.
Figure 15:
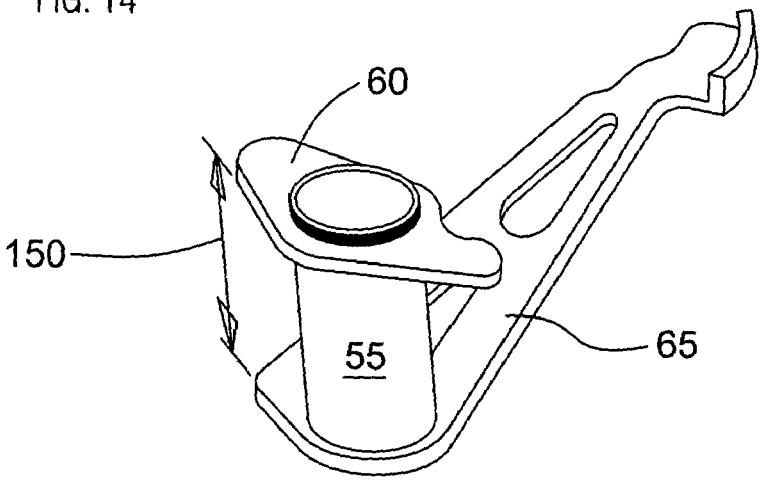
FIG. 15 is a perspective view of the valve-operating lever of FIG. 2.

The follower arm 65 is positioned on the second end 75 of the connector member 55 to continue the assembly process. As illustrated in FIGS. 14 and 15, the follower arm 65 is positioned at a desired angle 145 relative to the valve arm 60 and at a desired height 150 or distance from the follower arm 65. The angle 145 and distance 150 will vary depending on the application intended for the completed valve-operating lever 15. Once the follower arm 65 is properly positioned, the second end 75 of the connector member 55 is roller burnished to complete the assembly.

In one assembly process, a fixture (not shown) rigidly holds the connector member 55/valve arm 60 assembly and also positions the follower arm 65 at the desired angle 145 and height 150 from the valve arm 60. The fixture greatly improves the accuracy and speed of the assembly process. In addition, the fixture makes the positioning of the shoulders 90 less important as the fixture assures the proper orientation and spacing between the arms 60, 65 no matter where the first attached arm 60 is located.

It should be noted that while the foregoing described the assembly as first connecting the valve arm 60 to the connector member 55, one of ordinary skill will realize that the follower arm 65 could be connected first. As such, the assembly method should not be read as requiring that the valve arm 60 be connected before the follower arm 65.

Figure 16:
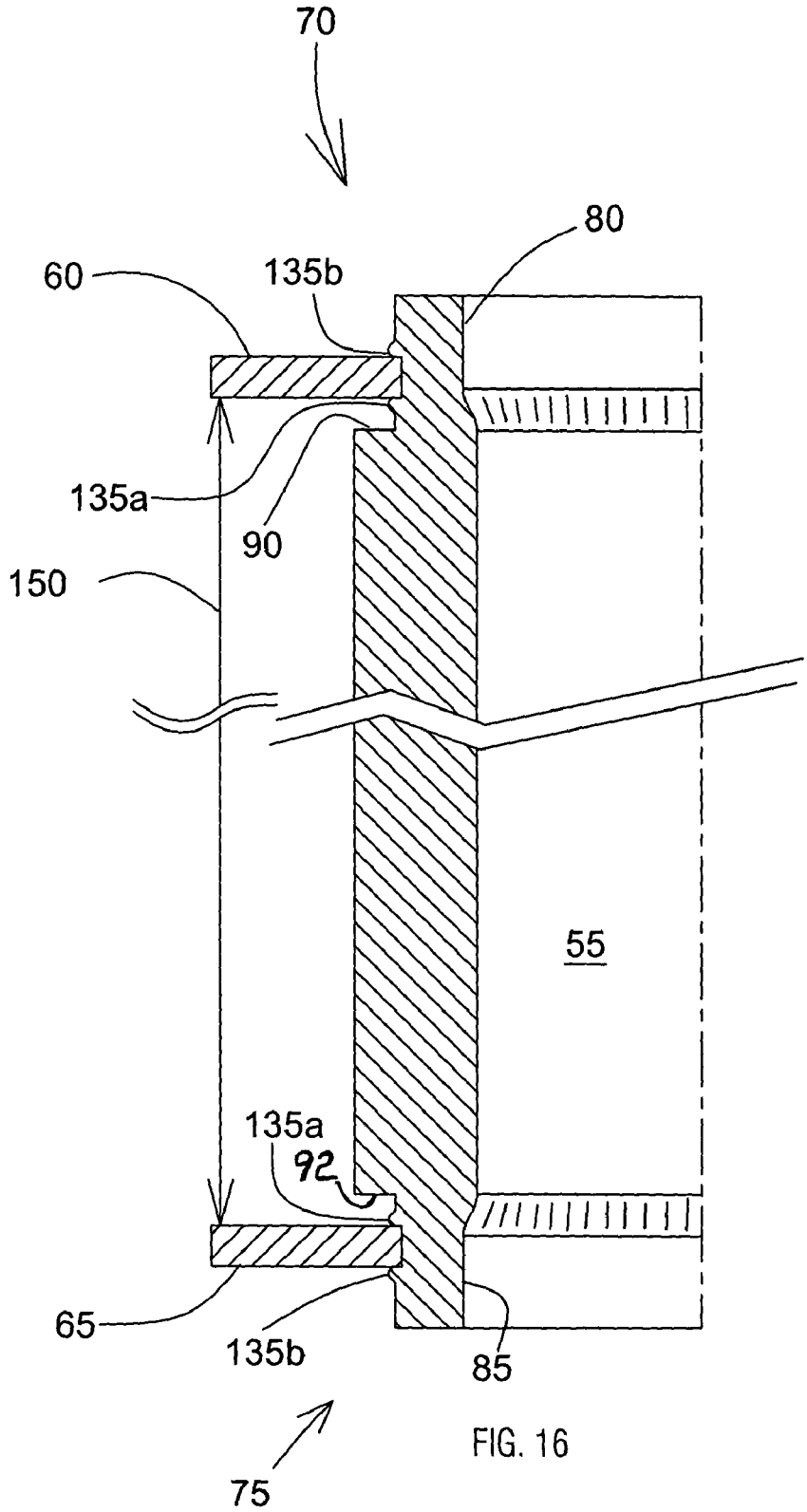
FIG. 16 is a cross-sectional view of the valve-operating lever after roller burnishing.

In still another construction, a single fixture supports the connector member 55, the follower arm 65, and the valve arm 60 in the proper positions for assembly. Both ends of the connector member 70, 75 are then roller burnished substantially simultaneously or sequentially. FIG. 16 illustrates the result of this assembly method. Because the fixture properly locates the parts 55, 60, 65 the assembly does not rely on the shoulder locations to position one or both of the arms 60, 65. Thus, the roller burnishing produces two lips (an inner lip 135*a* and an outer lip 135*b*) that overlay each of the arms 60, 65. The two lips 135*a*, 135*b* cooperate to inhibit axial movement of the arms 60, 65 relative to the connector member 55.

Figure 8:
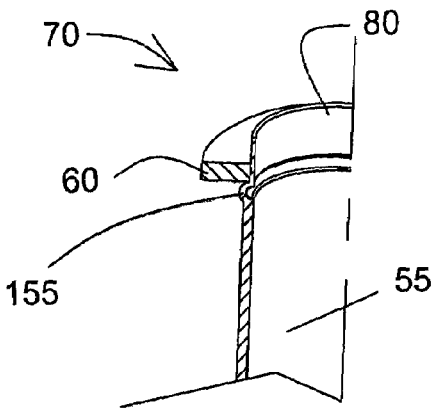
FIG. 8 is cross-sectional view of another partial assembly including a swaged portion.
Figure 8A:
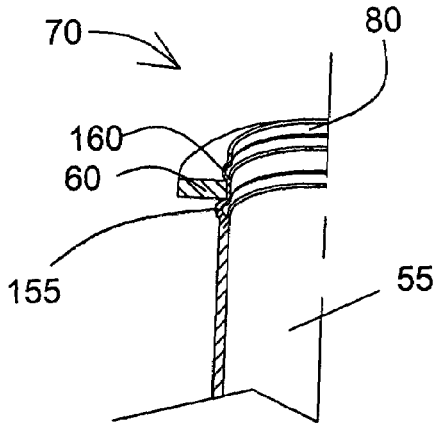
FIG. 8*a* is cross-sectional view of the partial assembly of FIG. 8 including a second swaged portion.

FIGS. 8 and 8*a* illustrate yet another method of attaching an arm 60 to the connector member 55. With reference to FIG. 8, a single swage 155 is formed in the connector member 55. The swage 155 is a deformation of the reduced-diameter portion 80 of the connector member 55 that extends completely around the connector member 55. The arm 60 is placed onto the end of the connector member 55 until it abuts the first swage 155. A second swage 160 is then formed above the arm 60 to fix its axial position relative to the connector member 55 as illustrated in FIG. 8*a*. This process is repeated for the second arm 60. Like the other methods described herein, a fixture could be used to support the various components 55, 60, 65 in their desired positions, thereby allowing for the simultaneous connection of both arms 60, 65.

The swages can be formed in any known manner so long as they can be positioned to retain the arms 60, 65. Compressing the connector member in an axial direction such that the material deforms in an outward (radial) direction can form swages. In another system, supplying high-pressure fluid to the interior of the connector member 55 while the connector member is restrained within a fixture forms swages. The high-pressure fluid acts to form the swages in the connector member 55 with the arms 60, 65 in their desired positions. One of ordinary skill will realize that many methods of forming swages are available and will function to form the lever arm 15 as described herein.

Although the invention has been described in detail with reference to certain preferred embodiments, variations and modifications exist within the scope and spirit of the invention as described and defined in the following claims.

What is claimed is:

1. A direct lever system for an engine, the system comprising:

a cylinder bore, the cylinder bore having an outer end;

a cam assembly having at least one cam surface and an axis inward of the outer end of the cylinder bore;

two valves having opened and closed positions;

two valve stems, each valve stem attached to one of the two valves;

a cylinder head substantially enclosing the outer end, the valves being seated in the cylinder head; and two pivotably mounted valve-operating levers, at least one of the valve-operating levers including, a connector member having a follower arm end defining a first reduced-diameter portion and a valve arm end defining a second reduced-diameter portion separate from the first reduced-diameter portion, the connector member defining a pivot axis about which the valve-operating lever pivots;

a follower arm including an aperture, a portion of the connector member engaging at least a portion of the follower arm adjacent the aperture to fixedly attach the follower arm to the connector member, the follower arm having a cam follower surface in contact with the at least one cam surface; and a valve arm including an aperture, a portion of the connector member engaging at least a portion of the valve arm adjacent the aperture to fixedly attach the valve arm to the connector member.

2. The system of claim 1, wherein the follower arm aperture and the valve arm aperture are substantially circular.

3. The system of claim 1, wherein the valve arm is formed from a stamped metal.

4. The system of claim 1, wherein the connector member valve arm end includes a first stop.

5. The system of claim 4, wherein the first stop includes a first shoulder at least partially defined by the first reduced-diameter portion.

6. The system of claim 4, wherein the valve arm defines a valve arm thickness and wherein the first reduced-diameter portion defines a first axial length that is at least as great as the valve arm thickness.

7. The system of claim 1, wherein the connector member valve arm end includes a first stop integrally-formed as one piece with the connector member valve arm end.

8. The system of claim 1, wherein at least one of the follower arm aperture and the follower arm end of the connector member includes knurls.

9. The system of claim 1, wherein at least one of the valve arm aperture and the valve arm end of the connector member includes knurls.

10. The system of claim 1, wherein the connector member follower arm end includes a follower arm end stop.

11. The system of claim 10, wherein the follower arm end stop includes a second shoulder defined by a follower arm end reduced-diameter portion.

12. The system of claim 10, wherein the follower arm defines a follower arm thickness and the second reduced-diameter portion defines a second axial length that is at least as great as the follower arm thickness.

13. The system of claim 1, wherein the first reduced-diameter portion defines a first diameter having a first center and the second reduced-diameter portion defines a second diameter having a second center, the first center and the second center being substantially disposed on the pivot axis.

* * * * *